US005169015A

United States Patent [19]

Burke

[11] Patent Number: 5,169,015

[45] Date of Patent: Dec. 8, 1992

[54] VEHICLE RADIATOR CAP WITH AUXILIARY VACUUM SEAL

[75] Inventor: Lawrence H. Burke, Oregon, Ill.

[73] Assignee: Stant Corporation, Dixon, Ill.

[21] Appl. No.: 839,099

[22] Filed: Feb. 20, 1992

[51] Int. Cl.[5] ..... B65D 51/16

[52] U.S. Cl. ..... 220/203; 220/231; 220/303; 220/DIG. 32

[58] Field of Search ..... 220/202, 203, 204, 209, 220/231, 293, 295, 298, 301, 303, 304, DIG. 32

[56] References Cited

U.S. PATENT DOCUMENTS

| | | | |
|---|---|---|---|
| 2,181,969 | 12/1939 | Eshbaugh | 220/DIG. 32 X |
| 2,195,266 | 2/1939 | Bailey . | |
| 2,603,379 | 7/1952 | Friend | 220/231 |
| 2,679,946 | 6/1954 | Friend . | |
| 2,918,191 | 12/1959 | Pipes et al. . | |
| 2,968,421 | 1/1961 | Eshbaugh . | |
| 2,990,971 | 7/1961 | Enell . | |
| 3,027,043 | 3/1962 | Nestic . | |
| 3,061,138 | 10/1962 | Edlemann et al. . | |
| 3,074,588 | 1/1963 | Burdue . | |
| 3,082,905 | 3/1963 | Friend | 220/231 |
| 3,111,239 | 11/1963 | Ivins . | |
| 3,112,840 | 12/1963 | Miller et al. | 220/231 |
| 3,186,580 | 6/1965 | Previte . | |
| 3,189,213 | 6/1965 | Nimmo . | |
| 3,373,894 | 3/1968 | Johnson . | |
| 3,587,912 | 6/1971 | Nagoya et al. | 220/231 |
| 3,715,049 | 2/1973 | McMullen . | |
| 3,878,965 | 4/1975 | Crute . | |
| 3,910,451 | 10/1975 | Tusing . | |
| 4,079,855 | 3/1978 | Avrea . | |
| 4,136,795 | 1/1979 | Crute et al. . | |
| 4,185,751 | 1/1980 | Moore et al. . | |
| 4,241,845 | 12/1980 | Daly et al. . | |
| 4,271,976 | 6/1981 | Detwiler | 220/206 |
| 4,498,599 | 2/1985 | Avrea . | |

OTHER PUBLICATIONS

Society of Automotive Engineers, "Radiator Caps and Filler Necks Standards," SAE J164 Mar. 82, SAE J151 (1982).

*Primary Examiner*—Stephen Marcus
*Assistant Examiner*—Nova Stucker
*Attorney, Agent, or Firm*—Allegretti & Witcoff, Ltd.

[57] ABSTRACT

A radiator cap including a manually manipulable crown provides an auxiliary vacuum seal for sealing a potential vacuum leak path around a member penetrating through a central aperture of the crown. The member may be a rivet or stud which secures the crown, a bell housing and a discoid spring in an assembled condition. Alternatively, the member may be a vent pin connected to a manually manipulable safety lever. The auxiliary vacuum seal preferably takes the form of a resilient O-ring which surrounds the member and is sealingly interposed between the discoid spring, the member and the bell housing to seal a potential vacuum leak path between the member and the discoid spring.

9 Claims, 2 Drawing Sheets

VEHICLE RADIATOR CAP WITH AUXILIARY VACUUM SEAL

BACKGROUND OF THE INVENTION

A. Field of the Invention

The present invention relates generally to vehicle radiator caps of the type commonly associated with radiator fluid reservoirs for internal combustion engines. More particularly, the present invention relates to improved vehicle radiator cap designs having an auxiliary vacuum seal to enhance the sealing capability and performance of the cap. The present invention can also be said to relate to improvements in the manufacture of radiator caps, in that the present vehicle radiator cap invention is more susceptible to automation in its manufacture and simplified assembly techniques than in many previous designs.

B. Background Art

Liquid cooled internal combustion engines incorporate radiators coupled to the engines to dissipate heat generated by the engine. As the radiator fluid passes through the radiator, heat is given off to the environment, and the now relatively cooler fluid is returned to the engine. Radiator caps are designed to engage with the filler neck of the radiator and perform a number of specific functions, the primary one being to provide a seal for the filler neck of the radiator fluid reservoir.

After the engine is started, the operating temperature of the engine increases, causing an increase in the pressure in the radiator. Radiator caps typically include a pressure relief valve which is normally closed to prevent the escape of radiator fluid when normal pressures are generated within the radiator. However, when the pressure in the radiator builds up beyond the strength of the pressure relief spring, the valve is pushed open and the overflow radiator fluid escapes past the pressure relief valve. Most automobiles manufactured today have a coolant recovery system, in which the overflow radiator fluid flows out of a port in the radiator filler neck into an overflow tank. The overflow fluid or coolant is returned to the radiator reservoir upon the development of vacuum or subatmospheric pressure within the radiator after the engine has cooled. Radiator caps also typically have a vacuum relief valve which opens in response to the development of subatmospheric pressure within the radiator in order to facilitate the return of coolant from the overflow tank to the radiator reservoir proper.

As vehicle radiator technology has evolved, the performance and requirements of the associated radiator cap have become even more important. In particular, the advent of coolant recovery systems has meant that maintenance of vacuum within the cooling system during the engine cooldown period is especially critical. Consequently, there has been a need for vehicle radiator caps which provides a leak free closure of the radiator to prevent loss of vacuum.

At the present time, vehicle radiator caps generally come in two different varieties. In the first or standard variety, a central rivet or stud penetrates through an aperture in the crown and an aperture in a discoid spring of the radiator cap and secures together in an assembled condition the crown, the discoid spring and a bell housing. The crown, or top of the radiator cap, is typically designed to allow the crown to rotate freely with respect to the rivet while being retained by the rivet in order to prevent scuffing of the sealing gasket sealing the free end of the radiator fitter neck. Since the central aperture of the crown is a cleavence opening in a free-turning cap, it typically is not in a leak free condition. The discoid spring is thus generally considered to be the primary vacuum closure device in radiator caps since it is the outermost element in contact with the engine coolant. In the standard-type caps of the prior art, the upsetting or swaging of the rivet must be carefully controlled so as to fill the central aperture in the discoid spring in order to prevent leakage between the rivet and discoid spring. In standard-type radiator caps without a free-turning or swivel crown, the opening in the discoid spring must be leak free while it is sandwiched between the crown and bell housing, a formidable challenge. Torque forces applied to the crown during installation and removal of the cap eventually loosen the rivet and cause leakage. Under either approach to the standard-type cap, the provision of a leak free cap whereby the vacuum leak path between the discoid spring and the central rivet is sealed effectively, has eluded those in the art.

The second type of radiator cap is known generally as a lever-type cap. This type of cap has a vent pin interconnected to a manually operated lever such that when the lever is raised, the vent pin is pushed downward to open a pressure relief valve thereby relieving pressure in the radiator prior to removal of the cap. As with the standard-type cap, a crown with a central aperture and a discoid spring are typically found in this type of cap. The vent pin is sized to be a clearance fit within the aperture of the discoid spring. The vent pin typically is free to rotate relative to the discoid spring as well as reciprocate within the aperture of the discoid spring. The clearance required between the vent pin and discoid spring is thus a vacuum leak path. The provision of a leak free cap by effectively sealing the vacuum leak path between the vent pin and the discoid spring has also eluded those in the art.

Workers in the art have produced a number of radiator cap designs to augment the sealing properties of vehicle radiator caps. Particular reference is made to the sealing arrangements disclosed in U.S. Pat. No. 4,271,976 issued to Detwiler, U.S. Pat. No. 3,074,588 issued to Burdue, and U.S. Pat. Nos. 4,079,855 and 4,498,599, both issued to Avera. The present invention represents an improvement on the sealing and valving techniques disclosed in these references.

SUMMARY OF THE INVENTION

The present invention relates to a radiator cap for closing the filler neck of a radiator fluid reservoir. The radiator cap comprises a manually manipulable crown having a central aperture which covers the filler neck. A spring disc is further provided which also has a central aperture. Generically speaking, a member extends through the central apertures of the crown and spring disc and an auxiliary vacuum seal is provided which is sealingly interposed between the discoid spring and the member to enhance the sealing properties of the cap by sealing the potential vacuum leak path between the member and the discoid spring. In the standard-type of radiator cap, the member is a means for securing the crown and bell housing together, such as a central rivet or stud. In the lever-type radiator cap, the member is the vent pin interconnected to the lever. In the preferred embodiment of the invention, the auxiliary vacuum seal is an elastomeric O-ring surrounding the member. In one aspect of the invention, the radiator cap includes a bell housing with an inner peripheral shoulder region which defines a space for the auxiliary vacuum seal such that the auxiliary vacuum seal is pressed by the bell housing into intimate contact with the discoid spring and the vent pin or rivet.

The principal object of the invention is to provide a leak-proof radiator cap. This object is achieved by providing the auxiliary vacuum seal as disclosed herein, which seals the potential leak path between the rivet or vent pin and the discoid spring. The auxiliary vacuum seal of the present invention is well suited as a reciprocal seal, as well as a rotational seal, maintaining a seal between the discoid spring and rivet or vent pin regardless of rotation of the rivet or vent pin relative to the auxiliary vacuum seal, or reciprocation of the vent pin, relative to the auxiliary vacuum seal.

A further object of the invention is to simplify the assembly and manufacture of radiator caps while producing a leak-proof radiator cap. By virtue of the present invention, clearance fits for the rivet and vent pin would certainly allow leakage were they not aided by the auxiliary vacuum seal of the present invention. The clearance fit made possible by the present invention simplifies the assembly and reduces manufacturing costs of the radiator cap, since the parts to the radiator cap can be simply dropped into place on the central member.

Furthermore, the radiator cap of the present invention is more robust and reliable over the long term than many other caps in the prior art. The integrity of the coolant recovery system is not subject to deterioration over time since the sealing properties of the cap do not degrade due to repeated installation and removal of the cap from the filler neck.

Other objects, advantages and features of the present invention will become apparent from the following detailed description of presently preferred embodiments of the invention.

BRIEF DESCRIPTION OF THE DRAWINGS

There is shown in the attached drawing presently preferred embodiments of the present invention, wherein like numerals refer to like elements in the various views.

DETAILED DESCRIPTION OF THE PREFERRED EMBODIMENTS

Figure 2:
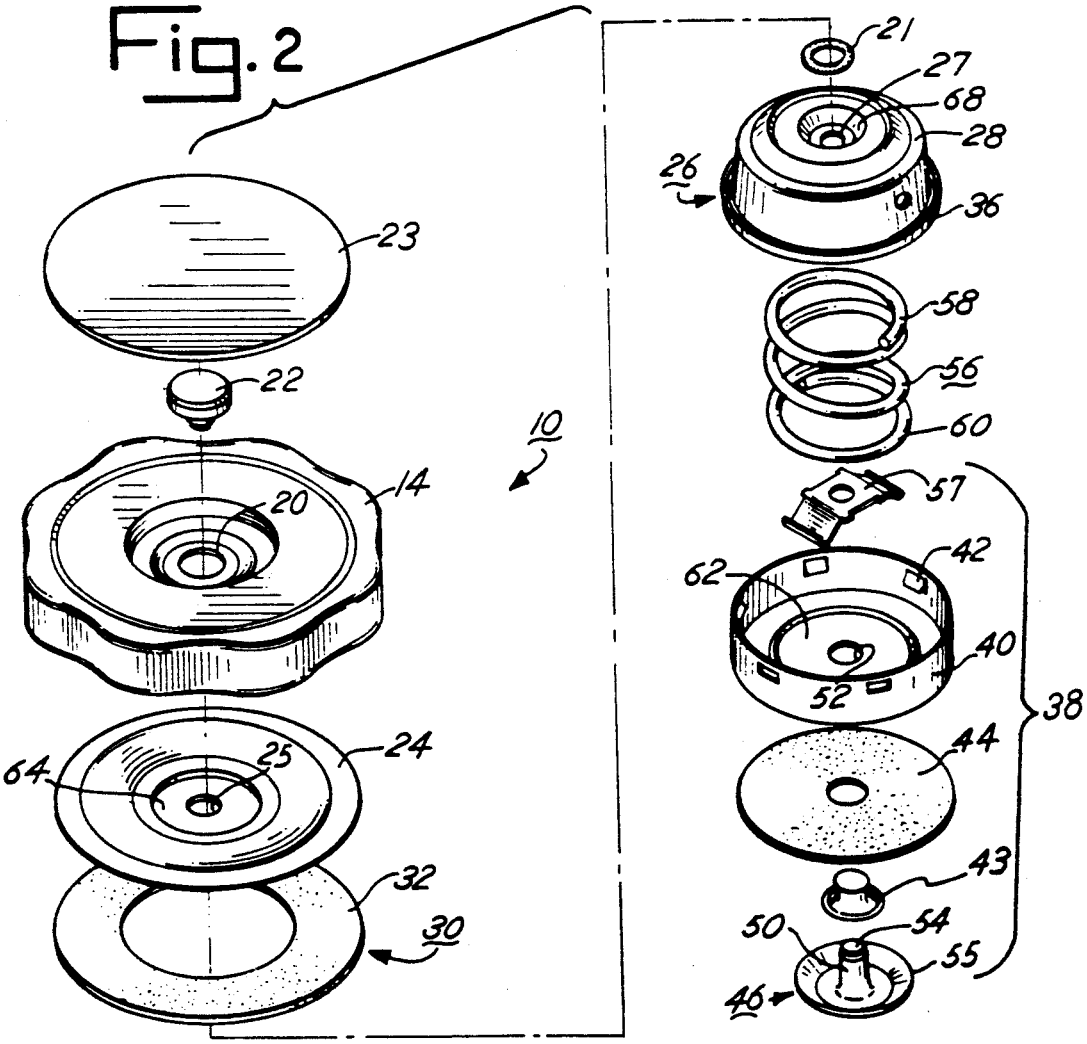
FIG. 2 is an exploded view of the radiator cap of FIG. 1.
Figure 3:
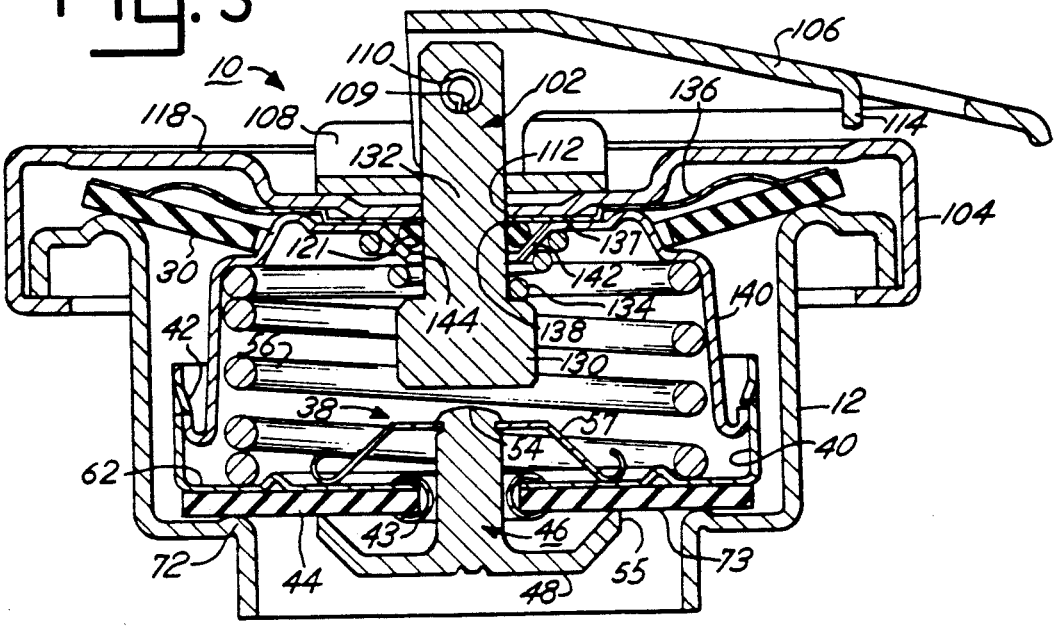
FIG. 3 is a cross-sectional view of a lever-type radiator cap constructed according to the present invention installed on a radiator filler neck.
Figure 4:
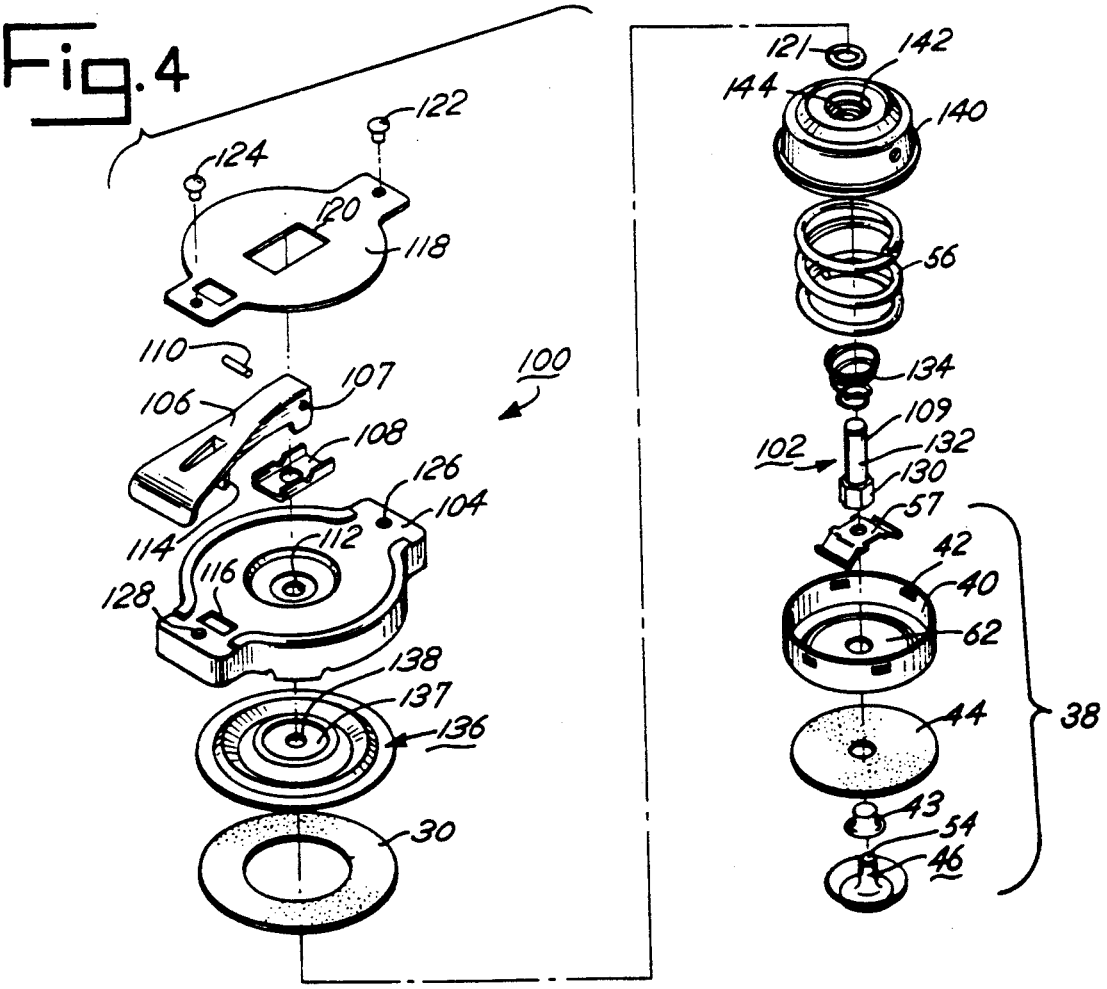
FIG. 4 is an exploded view of the radiator cap of FIG. 3.

The present invention is adaptable to both standard and lever-type radiator caps to perform the function of sealing a potential leak path between a member, which penetrates through a central aperture in a crown, and the discoid spring. A preferred embodiment of the invention in a standard-type radiator cap is illustrated in FIGS. 1 and 2, a preferred embodiment of the invention in a lever-type radiator cap is illustrated in FIGS. 3 and 4.

Figure 1:
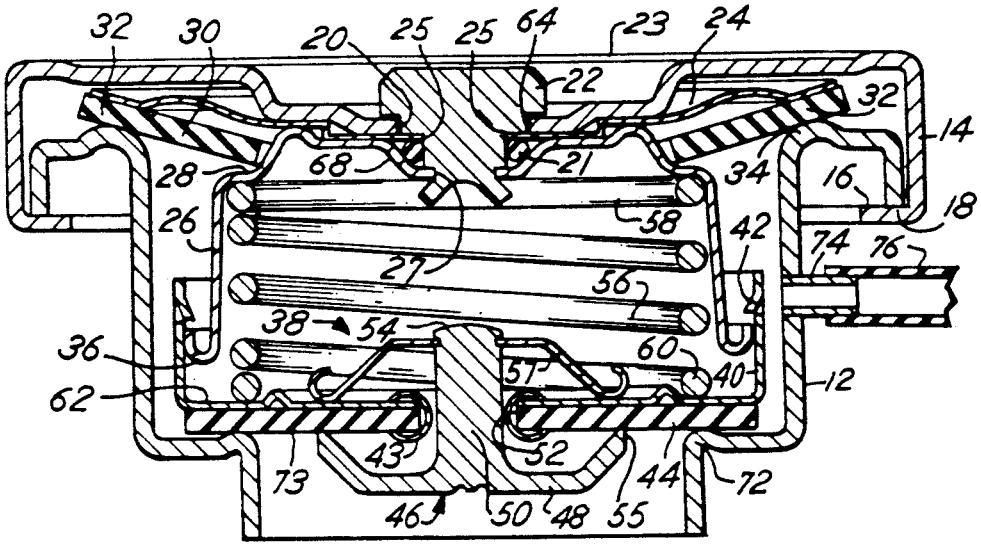
FIG. 1 is a cross-sectional view of a standard-type radiator cap constructed according to the present invention installed on a radiator filler neck.

FIG. 1 depicts in vertical cross-section a radiator cap 10 according to the present invention installed on a conventional radiator filler neck 12. Referring now to both FIG. 1 and FIG. 2, which is an exploded view of the cap of FIG. 1, the cap 10 includes a manually manipulable crown or shell 14 covering the filler neck 12. The crown 14 has a pair of oppositely opposed cam fingers 16 which pass through corresponding openings (not shown) in the filler neck 12 and engage the lip 18 of the filler neck 12 when the crown 14 is rotated onto the filler neck 12 to thereby secure the cap 10 to the filler neck 12. The crown 14 also is shown as having a central aperture 20. A rivet 22 extends through the aperture 20 and after staking to its flared shape, the rivet 22 secures in an assembled condition the crown 14, a discoid spring 24 having a central aperture 25, and a bell housing 26 having a central aperture 27. The cap 10 is also provided with a cover 23 which covers the rivet 22. The cap 10 includes an auxiliary vacuum seal 21 to seal a potential leak path between the rivet 22 and the discoid spring 24. The auxiliary vacuum seal 21 is discussed in greater detail below.

The bell housing 26 has an outer peripheral shoulder region 28 which supports a discoid rubber seal 30. The rubber seal 30 has an outer peripheral region 32 which makes sealing contact with an upper annular seat 34 of the filler neck 12. The crown 14, once installed on the filler neck 12, provides the downward force onto the discoid spring 24 to produce the compression on the rubber seal 30 required to prevent leakage of the overflow fluid at the top of the filler neck 12. By using the shoulder region 28 of the bell housing to support the rubber seal 30, the necessity of using a support member for the seal as a discrete structural element as is often found in prior art designs is eliminated.

The bell housing 26 includes a lower radially outwardly extending flange 36 which carries a pressure-vacuum valve assembly 38. The valve assembly 38 includes a seal support plate 40 having its downward movement limited by the abutment of the flange 36 with a plurality of inwardly projecting tabs 42 on the seal support plate 40. An eyelet 43 secures a primary vacuum seal 44 adjacent to the bottom surface 62 of the seal support plate 40. The vacuum seal 44 can be fabricated from a resilient sealing material, such as rubber. The valve assembly 38 also includes a vacuum valve 46 comprising a valve head 48 and an elongate shank 50. The shank 50 extends through an aperture 52 in the seal support plate 40 and has an upper end 54 which is staked to retain a leaf spring 57. The leaf spring 57 biases the vacuum valve 46 to a closed position such that the annular peripheral region 55 of the valve head 48 exerts upward forces on the vacuum seal 44 to seal the primary path for air and fluid flow, i.e., the clearance region between the shank 50 of vacuum valve 46 and the eyelet 43.

The radiator cap 10 further includes a pressure spring 56 nested inside the bell housing 26. The pressure spring 56 is a coil spring having an upper turn 58 snugly engaging the outer peripheral shoulder region 28 of the bell housing 26, obviating the need for a separate structural element to act as a stop for the pressure spring 56. Pressure spring 56 has a lower turn 60 biasing the base portion 62 of the seal support plate 40.

The pressure spring 56, seal support plate 40 and bell housing 26 are designed so that when the cap 10 is installed on the filler neck 12, the seal support plate 40 and bell housing 26 are under a minimum of stress. As the seal support plate is subject to high temperatures, humidities and pressures for long periods of time, the seal support plate 40 is prone to creep or distortion, which can lead to a reduction of the sealing capabilities of the vacuum seal 44. It can be seen from FIG. 1 that the lower turn 60 of pressure spring 56 is designed to be centered over and apply forces substantially directly above the annular valve seat 72 of the filler neck 12, thus reducing the possibility of any creep or distortion of the seal support plate 40 over a long period of time. The seal support plate 40 can be made of metal or plastic, the choice depending upon such factors as the calibration of pressure spring 56 and cost. Also, the snug fitting of the upper turn 58 of the pressure spring 56 in the shoulder region 28 of the bell housing 26 reduces the likelihood of any creep occurring in the shoulder region 28 of the bell housing 26.

Referring now in particular to FIG. 1, the auxiliary seal 21 is now discussed in greater detail. Prior standard-type radiator cap designs without the auxiliary vacuum seal design of the present invention typically attempted to seal the potential leak path around the central rivet or stud by making the innermost region of the discoid spring snugly fit against the rivet. See, e.g., FIGS. 1 and 2 of U.S. Pat. No. 3,878,965 issued to Crute. However, this prior design is subject to the eventual loosening of the connection between the spring disc and central rivet, allowing leakage to occur after repeated installations of the cap onto a filler neck. The use of a swivel crown design relieves the problem of loosening and leakage to a certain extent, but heretofore, the solution of adding an auxiliary vacuum seal has eluded those in the art. In the preferred embodiment of FIG. 1, the discoid spring 24 has an inner peripheral portion 64 which is adjacent to its central aperture 25. The rivet 22 extends through the central aperture 25. The bell housing 26 is provided with an inner peripheral shoulder region 68 defining a space for the auxiliary vacuum seal 21 such that the auxiliary vacuum seal 21 is pressed between the bell housing 26 and the rivet 22. Also, the inner peripheral shoulder region 68 causes the auxiliary vacuum seal 21 to be pressed against inner peripheral portion 64 the discoid spring 24. The auxiliary vacuum seal 21, preferably an elastomeric material such as rubber formed in the shape of an O-ring, remains to seal the leak path between the rivet 22 and the discoid spring 24 regardless of part rotation or slippage. The auxiliary vacuum seal 21 thus resembles a "rotating shaft seal" as found in pneumatic and hydraulic systems.

With the auxiliary vacuum seal design of the present invention, the manufacturing process is improved because the fit between the rivet and the discoid spring is not as critical to producing a leak-free product as it is in prior designs without the auxiliary seal feature. The leak path is controlled by the auxiliary O-ring seal 21 and, as long as the parts are secured in place, the cap will not leak. The design is thus a robust design. Since fit and tolerance are not as critical, and a clearance fit is possible between rivet 22 and discoid spring 24, the design lends itself better to automation than pre-existing designs, and facilitates faster and less expensive manufacturing techniques for the cap.

Referring again to FIG. 1, in operation, the lower turn 60 of the pressure spring 56 exerts downward forces on the seal support plate 40 such that the vacuum seal 44 maintains sealing contact with the annular valve seat 72 of the filler neck 12 under normal operating conditions. Upon the development of abnormally high superatmospheric pressure in the radiator, creating upward pressures on the valve head 48 and peripheral region 73 of the seal 44, the valve assembly 38 lifts bodily upward, permitting the flow of radiator fluid around the vacuum seal 44 and out an overflow port 74 through a tube 76 running to an overflow tank (not shown in FIG. 1). Upon the development of subatmospheric pressures within the radiator when the engine has cooled, the valve assembly 38 reseats on valve seat 72 and vacuum valve 46 opens, thereby allowing coolant to be siphoned back from the overflow tank to pass through the clearance region between eyelet 43 and shank 50, and past the peripheral region 55 of the valve head 48 to return to the radiator fluid reservoir. During this pressure and vacuum cycle, the auxiliary vacuum seal 21 maintains a sealing engagement with the rivet 22, bell housing 26 and discoid spring 24 to seal the potential leak path between the rivet 22 and the discoid spring 24. Seal integrity and performance of the coolant recovery system is maintained, even after repeated installation or removal of the radiator cap 10.

Referring now to FIGS. 3 and 4, an alternative preferred embodiment of the invention is shown. In this embodiment, a lever-type radiator cap 100 having a vent pin 102 and a crown 104 is provided which incorporates an auxiliary vacuum seal 121 to seal a potential leak path between the vent pin 102 and a discoid spring 136.

The radiator cap 100 is provided with a lever assembly which includes a lever 106, a bracket 108 and a pin 110. The vent pin 102 reciprocates within an aperture 112 provided in the crown 104 and is interconnected to the lever 106 by means of the pin 110 which passes through aperture 107 on lever 106 and through the aperture 109 on vent pin 102. The lever 106 includes a downwardly projecting tang 114 which projects through a slot 116 in the peripheral region of the crown 104 and engages a notch (not shown in FIGS. 1-4) in the filler neck 12. The tang 114 serves to prevent unintentional removal of the cap 100 from the filler neck 12 prior to lifting the lever and relieving system pressure. The cap 100 further includes a cover plate 118 having a central slot 120 which fits over the bracket 108. The cover plate 118 is secured to the crown 104 by means of a pair of rivets 122, 124 which project through rivet holes 126, 128 in crown 104. The cover plate 118 keeps the bracket 108 from rotating and insures that the tang 114 always enters the slot 116 when the radiator cap is installed.

Still referring to FIGS. 3 and 4, the radiator cap 100 is provided with a discoid spring 136 having a central aperture 138. Below the discoid spring 136 is a bell housing 140 having an inner peripheral shoulder region 142 which defines a space for the auxiliary vacuum seal 121. The central apertures 112, 138 and 144 of the crown 104, discoid spring 136 and bell housing 140, respectively, are designed such that the vent pin 102 can freely reciprocate within the apertures when the lever 106 is raised and lowered. The auxiliary seal 121 is kept in sealing relationship between the vent pin 102 and the inner peripheral portion 137 of the discoid spring 136 by the bell housing 140 to seal the potential leak path which exists between the vent pin 102 and the discoid spring 136.

The vent pin 102 is provided with a head portion 130 and an elongate cylindrical shank 132. A lever return spring 134 is provided which biases the vent pin 102 downward towards the upper end 54 of the vacuum valve 46. The vent pin 102 is held in a retracted position as shown in FIG. 3 while the lever 106 is held in the lower or locked position as when the cap 100 is installed on the filler neck 12. When the lever 106 is raised manually, the shaft 132 of the vent pin 102 moves downward through the auxiliary seal 121 due to the force of the spring 134 until the head portion 130 engages the upper end 54 of the vacuum valve 46. The spring constant of lever return spring 134 is selected such that the downward force exerted by the spring 134 onto the head portion 130 of the vent pin 102 will always exceed the force that the cooling system will be able to exert against the valve head 48 in the opposite direction. Thus, by raising the lever 106,-the vent pin 102 will be pushed lower by the lever return spring 134 to cause the vacuum valve 46 to open, allowing the cooling system pressure to be relieved. The lever return spring 134 also serves to provide the force to press the auxiliary seal 121 against the discoid spring 136 and vent pin 102 to make a secure seal therebetween.

It will be readily apparent to one of ordinary skill in the art that the remaining structure concerning the bell housing 140, pressure spring 56, pressure-vacuum assembly 38, and gasket 30 of the radiator cap of FIG. 3 follows the structure of the radiator cap of FIGS. 1 and 2, and like elements in FIGS. 3 and 4 and FIGS. 1 and 2 are accordingly given like reference numerals. Moreover, the radiator cap of FIG. 3 operates in an analogous manner to the radiator cap of FIGS. 1 and 2 once the radiator cap 100 is installed on the filler neck 12.

A principal similarity between the two embodiments of FIGS. 1 and 2 and FIGS. 3 and 4 of the present invention is the provision of an auxiliary vacuum seal 21, 121 which seals the potential leak path between the discoid spring and the members which penetrate through the aperture in the crowns, i.e., the rivet 22 in the embodiment of FIG. 1 and the vent pin 102 in the embodiment of FIG. 3.

While I have described herein preferred embodiments of the present invention, it is to be understood that changes and modifications can be made without departing from the true scope and spirit of the present invention. For example, different constructions for a rivet and bell housing may be provided which accommodate an auxiliary vacuum seal. Also, the auxiliary vacuum seal may be pressed into sealing engagement between the crown, bell housing and member without making sealing contact with a discoid spring. Further, while the auxiliary vacuum seal is shown as a single seal, two seals could be utilized as well. This true scope and spirit is defined by the following claims and their equivalents, to be interpreted in light of the foregoing specification.

What is claimed is:

1. In a coolant recovery system, a radiator cap for closing the filler neck of a radiator fluid reservoir, said filler neck including an overflow port, comprising:

a manually manipulable crown covering said filler neck, said crown having a central aperture;

a member extending through said aperture;

a discoid spring having an inner peripheral portion defining a central aperture, said inner peripheral portion adjacent to said member;

a bell housing having a central aperture; and an auxiliary vacuum seal sealingly engaging said bell housing, discoid spring and said member to seal a vacuum leak path between said discoid spring and said member, thereby permitting coolant to be recovered by said radiator fluid reservoir through said overflow port upon the development of subatmospheric pressure within said radiator fluid reservoir.

2. The radiator cap as claimed in claim 1 wherein said member comprises a means for securing said crown and bell housing in an assembled condition.

3. The radiator cap as claimed in claim 1 wherein said radiator cap further comprises a manually manipulable lever and wherein said member comprises a vent pin interconnected to said lever.

4. The radiator cap as claimed in claim 1 wherein said auxiliary vacuum seal comprises an elastomeric O-ring surrounding said member and sealingly engaging said inner peripheral portion of said discoid spring and said bell housing to seal a vacuum leak path between said inner peripheral portion of said discoid spring and said member.

5. The radiator cap as claimed in claim 2 wherein said bell housing is provided with a inner peripheral shoulder region defining a space for said auxiliary vacuum seal such that said auxiliary vacuum seal is pressed into sealing engagement between said discoid spring and said means for securing.

6. The radiator cap as claimed in claim 5 wherein said means for securing comprises a rivet securing said bell housing, discoid spring and crown in an assembled condition, such that said auxiliary vacuum seal is pressed by said bell housing into sealing engagement between said inner peripheral portion of said discoid spring and said rivet to thereby seal a potential vacuum leak path around said rivet.

7. The radiator cap as claimed in claim 3 wherein said bell housing is provided with a inner peripheral shoulder region defining a space for said auxiliary vacuum seal such that said auxiliary vacuum seal is pressed by said shoulder region into sealing engagement between said inner peripheral portion of said discoid spring and said vent pin to seal a vacuum leak path around said vent pin.

8. The radiator cap as claimed in claim 7 wherein said vent pin includes a head portion and wherein said radiator cap further includes a means for biasing said head portion to said lower position.

9. The radiator cap as claimed in claim 2 wherein said inner peripheral portion of said discoid spring has a clearance fit relative to said means for securing, thereby simplifying the manufacturing of said radiator cap.

* * * * *